US006386399B1

(12) United States Patent
Tsujii et al.

(10) Patent No.: US 6,386,399 B1
(45) Date of Patent: May 14, 2002

(54) CONTAINER WITH MANUAL PUMP

(75) Inventors: Norihiro Tsujii; Tatsuo Tsubaki, both of Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/700,737

(22) PCT Filed: Jul. 23, 1999

(86) PCT No.: PCT/JP99/03974

§ 371 Date: Dec. 26, 2000

§ 102(e) Date: Dec. 26, 2000

(87) PCT Pub. No.: WO00/04997

PCT Pub. Date: Feb. 3, 2000

(30) Foreign Application Priority Data

Jul. 24, 1998 (JP) ..... 10-208852
Jul. 24, 1998 (JP) ..... 10-208855
Jul. 22, 1999 (JP) ..... 11-207519
Jul. 22, 1999 (JP) ..... 11-207542

(51) Int. Cl.[7] ..... B67D 5/40
(52) U.S. Cl. ..... 222/376; 222/383.1
(58) Field of Search ..... 222/321.4, 376, 222/383.1, 402.19, 481

(56) References Cited

U.S. PATENT DOCUMENTS 2,924,360 A * 2/1960 Samuel ..... 222/394
3,794,202 A * 2/1974 Unger ..... 215/22
4,775,079 A * 10/1988 Grothoff ..... 222/321
4,942,985 A * 7/1990 Schultz ..... 222/376
4,993,214 A * 2/1991 Corba ..... 53/471
5,341,967 A * 8/1994 Silvenis ..... 222/376
5,462,209 A * 10/1995 Foster et al. ..... 222/376
5,803,319 A * 9/1998 Smith et al. ..... 222/402.19
6,220,483 B1 * 4/2001 Van der Heijen ..... 222/136

FOREIGN PATENT DOCUMENTS

JP 2-15264 1/1990
JP 8-332423 12/1996
WO WO 98/34733 * 8/1998 ..... 222/136

* cited by examiner

*Primary Examiner*—Henry C. Yuen
*Assistant Examiner*—Melvin Cartagena
(74) *Attorney, Agent, or Firm*—Oliff & Berridge, PLC

(57) ABSTRACT

The purpose of this invention is to prevent outside air from entering the bypass pipe portion when air is taken in the vessel for the prevention of a negative pressure, and thereby to secure normal, smooth liquid-discharging operation in the upside-down position of the vessel. For this purpose, the vessel equipped with a manual pump is also provided with a change-over valve unit 20 to switch the liquid supply to the manual pump 1 in response to the change in the posture of the vessel from the upright position to the upside-down position, and vice versa, so that the vessel can be used to discharge forcibly the liquid even in its upside-down position. In such a vessel, the channel taking outside air into the vessel 50 for preventing a negative pressure has an opening to the vessel 50 at the rear of the cap unit 40. The change-over valve unit 20 is attached to the cap unit 40 from downside in a posture tilted forward and downward so that the outside air rising to the liquid surface in the form of bubbles would not come close to the liquid intake slits of the change-over valve unit 20. It was also made easy for the check valve of the change-over valve unit 20 to sit stably on the valve seat.

4 Claims, 11 Drawing Sheets

CONTAINER WITH MANUAL PUMP

TECHNICAL FIELD

This invention relates to a vessel equipped with a manual pump used to suck up the liquid in the vessel and forcibly discharge the liquid from the vessel by pressing down the nozzle head or manipulating the lever, and relates in particular to the vessel equipped with a manual pump, which can be used in the upside-down position.

BACKGROUND OF THE INVENTION

Among the vessels equipped with a manual pump of the type in which a lotion, a detergent, an insecticide, etc., contained in a vessel is discharged or sprayed by pressing down the nozzle head or manipulating the lever, the representative prior-art vessels usable in the upside-down position are described in the Official Gazette of Japanese Patent Publication No. 90-15264 and the Official Gazette of Japanese Patent Application (OPI) No. 96-332423.

These prior-art vessels have a manual pump attached to the mouth of the vessel The vessels are also provided with a valve which can be linked with the cylinder of this manual pump and used in both of the upright and upside-down positions, wherein the valve has a casing (or a bypass) for an auxiliary valve (or a check valve) comprising a valve ball which serves as the check valve in the upright position. This auxiliary-valve casing (bypass) is provided with a slit (or a lateral, narrow hole) between the valve seat and a stopper which prevents the auxiliary valve (check valve) from coming off. An intake pipe (or a sucking pipe) is fitted to the lower end of the valve, and in addition, a vacuum control mechanism is disposed above the auxiliary-valve casing (bypass) to prevent a negative pressure inside the vessel caused by a decrease in liquid volume.

When the vessel is used in its upright position, liquid is sucked up through the intake pipe (the sucking pipe) and discharged forcibly by manipulating the nozzle head or the lever. When the vessel is used in its upside-down position, liquid is sucked up through the slit in the auxiliary-valve casing (bypass) in the open valve state and is discharged forcibly by the manipulation of the manual pump. In either case, a negative pressure inside the vessel caused by a decrease in liquid volume is prevented by taking in outside air through the vacuum control mechanism.

However, the aforementioned prior-art vessels had a problem in that, when they are used in the upside-down position, air taken in through the vacuum control mechanism rises in the liquid and is sucked up, along with the liquid, through the liquid intake slit into the auxiliary-valve casing (bypass) located right above the vacuum control mechanism. Thus, air gets mixed with the liquid which is to be forcibly discharged by the manipulation of the manual pump, thereby making the liquid-discharging operation out of order.

The prior-art vessels had also another problem in that, when the auxiliary-valve casing (bypass) is in a roughly horizontal position, the spherical check valve cannot roll on the inclined valve seat surface to sit on the valve seat. If the slit in the auxiliary-valve casing (bypass) is exposed to air, the pump function area sucks up air through this slit, thus making the liquid-discharging operation out of order.

This invention his been made to solve these problems found in the aforementioned prior-art vessels. Technically, this invention is aimed at establishing a normal, smooth liquid-discharging operation by taking in outside air for the prevention of a negative pressure inside the vessel and at that time preventing air from entering the pump when the vessel is used in the upside-down position.

This invention is also aimed at making sure that the check valve inside the auxiliary-valve casing (bypass) sits on the valve seat securely ,without rolling out of the valve seat slope even when the vessel is used in the roughly horizontal position.

DISCLOSURE OF THE INVENTION

The means of carrying out the invention according to claim 1 comprises:

Having a vessel in which to contain a liquid;

Having a manual pump which is attached to the mouth of this vessel by way of an attaching cylinder and is used to suck up liquid through the sucking pipe and to discharge forcibly the liquid from the nozzle by the manual operation of the pump lever;

Having a cap unit which is attached to the lower portion of the attaching cylinder of this manual pump and is provided with a liquid-flowing conduit cylinder linked to the manual pump;

Having a change-over valve unit which is attached to the cap unit from downside and is composed of a conduit pipe portion linked to the conduit cylinder of the cap unit, a bypass pipe portion having liquid intake slits in the bypass pipe wall and having a closed upper end, and a base pipe portion at the bottom of this unit; with the liquid flow between the conduit pipe portion and the bypass pipe portion being cut off in the upright position of the vessel, and liquid being allowed to flow between these two portions in the upside-down position, by the action of a check valve provided inside the bypass pipe portion;

Setting up a vacuum control air channel to the vessel by taking in outside air through a spot on the cylinder in a state in which the piston of the manual pump has moved to the inside of the cylinder, passing air into the vacant space inside the attaching cylinder of the manual pump, and supplying the vessel with air at the rear of the cap unit; and Attaching the change-over valve unit to the lower portion of the cap unit by tilting the valve unit forward and downward.

When the vessel is used in the upright position, the check valve inside the change-over valve unit cute off the liquid flow between the bypass pipe portion and the base pipe portion. After the liquid has been spouted out by manipulating the manual pump and pressure inside the cylinder has become negative due to the return of the piston, the liquid in the vessel is sucked up through the sucking pipe, the base pipe portion, and the conduit pipe portion of the change-over valve unit into the cylinder of the manual pump. At the same time, outside air is sucked up into the vessel through the vacuum control air channel to prevent the vessel from a negative pressure.

Since at that time, the flow between the bypass pipe portion and the base pipe portion is cut off by the check valve, the air taken in from outside never enters the base pipe portion through the bypass pipe portion, and therefore there is no fear that air gets mixed with liquid in the cylinder.

When the vessel is used in the upside-down position, the check valve of the change-over valve unit connects between the bypass pipe portion and the base pipe portion. After liquid has been spouted out by manipulating the manual pump and the pressure inside the vessel has become negative due to the return of the piston, the liquid in the vessel is sucked up through the liquid intake slits and the bypass pipe portion into the base pipe portion and is sent to the cylinder.

At that time, as liquid is sucked up into the cylinder, outside air is simultaneously taken into the vessel through the vacuum control air channel, and rises to the liquid surface in the form of bubbles at the rear of the cap unit.

Regarding the spot of air bubbles coming to surface, the change-over valve unit takes such a posture tilted forward and downward (or forward and upward in the upside-down position) that air goes away from the bypass pipe portion as the bubbles come up to the liquid surface. Therefore, the bubbling air from outside will never be sucked up into the bypass pipe portion through the liquid intake slits, and there is no fear that air gets mixed with liquid in the cylinder.

When the vessel is tilted toward the lying position due to a decrease in the liquid volume, the liquid intake slits of the bypass pipe portion is exposed to air although the lower end of the sucking pipe remains dipped in the liquid. Since, however, the bypass pipe portion is tilted forward and downward, the check valve takes its position on the valve seat, and thus, air will never be sucked up into the base pipe portion through the bypass pipe portion.

The invention according to claim 2 comprises the invention according to claim 1, wherein a connecting cylinder in a posture tilted forward and downward is disposed under the cap unit, is linked with the conduit cylinder, and is fitted around the upper portion of the conduit pipe portion of the change-over valve unit.

In the invention according to claim 2, the cap unit is provided with the connecting cylinder to which the change-over valve unit is attached in a posture tilted forward and downward. Since it is not necessary for this valve unit to have a functional portion for being attached to the cap unit in a tilted posture, use can be made of a combination of an existing change-over Valve unit with a sucking pipe as it is.

The means of carrying out the invention according to claim 3 comprises:

Having a vessel in which to contain a liquid;

Having a manual pump which is attached to the mouth of this vessel by way of an attaching cylinder and is used to suck up liquid through the sucking pipe and to discharge forcibly the liquid from the nozzle by the manual operation of the pump lever.

Having a cap unit which is attached to the lower portion of the attaching cylinder of this manual pump, and is provided with a liquid-flowing conduit cylinder linked to the manual pump;

Having a change-over valve unit which is attached to the cap unit from downside and is composed of a conduit pipe portion linked to the conduit cylinder of the cap unit, a bypass pipe portion having liquid intake slits in the bypass pipe wall and having a closed upper end and a valve seat at the lower end inside this bypass, and a base pipe portion at the bottom of this unit; with the liquid flow between the conduit pipe portion and the bypass pipe portion being cut off in the upright position of the vessel, and liquid being allowed to flow between these portions in the upside-down position, by the action of a spherical check valve provided inside the bypass pipe portion;

Setting up a vacuum control air channel by taking in outside air through a spot on the cylinder in a state in which the piston of the manual pump has moved to the inside of the cylinder, passing air into the vacant space inside the attaching cylinder of the manual pump, and supplying the vessel with air at the rear of the cap unit; and Having at least three guide ribs of a vertical ridge shape disposed circumferentially around the inner surface of the bypass pipe portion having a larger bore diameter than the diameter of the check valve, in an arrangement that positions the check valve axially at the center of the bypass pipe portion.

The check valve is supported by the guide ribs so as to remain axially at the center of the bypass pipe portion. Therefore, this valve rolls along the ridges of the guide ribs, and takes the valve seat without being affected by the slope of the valve seat surface.

Even if the vessel is used in such a way that the bypass pipe portion is in a roughly horizontal lying position and that air is allowed to enter the bypass pipe portion through the liquid intake slits, the check valve quickly and securely sits on the valve seat due to a slight force acting on the valve (such as the force created by a negative pressure on the base pipe side), and prevents air from entering the base pipe portion by way of the bypass pipe portion.

THE MOST PREFERRED EMBODIMENTS OF THIS INVENTION

Figure 1:
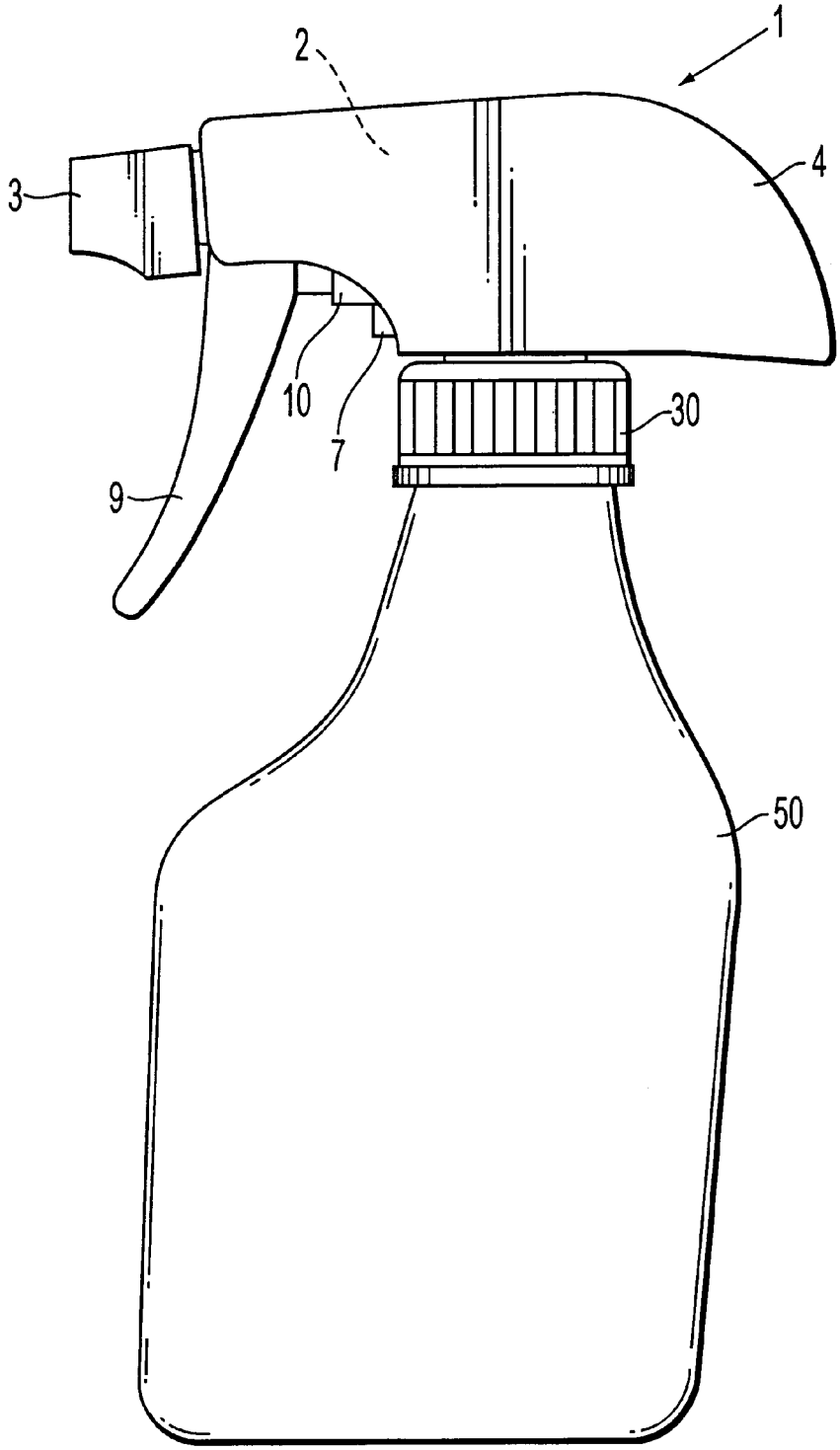
FIG. 1 is a general side view showing the vessel equipped with a manual pump in an embodiment of this invention.

The most preferred embodiments of this invention are further described, now referring to the drawings.

FIGS. 1, 2, 7 and 8 show the manual pump 1, a component to be used as a spray, which has been fitted by way of the fitting cap 30 to the mouth of the vessel 50 by the screw engagement. The pump body 2 has a cover 4 and is provided at the tip with a nozzle head 3 having an orifice.

Figure 2:
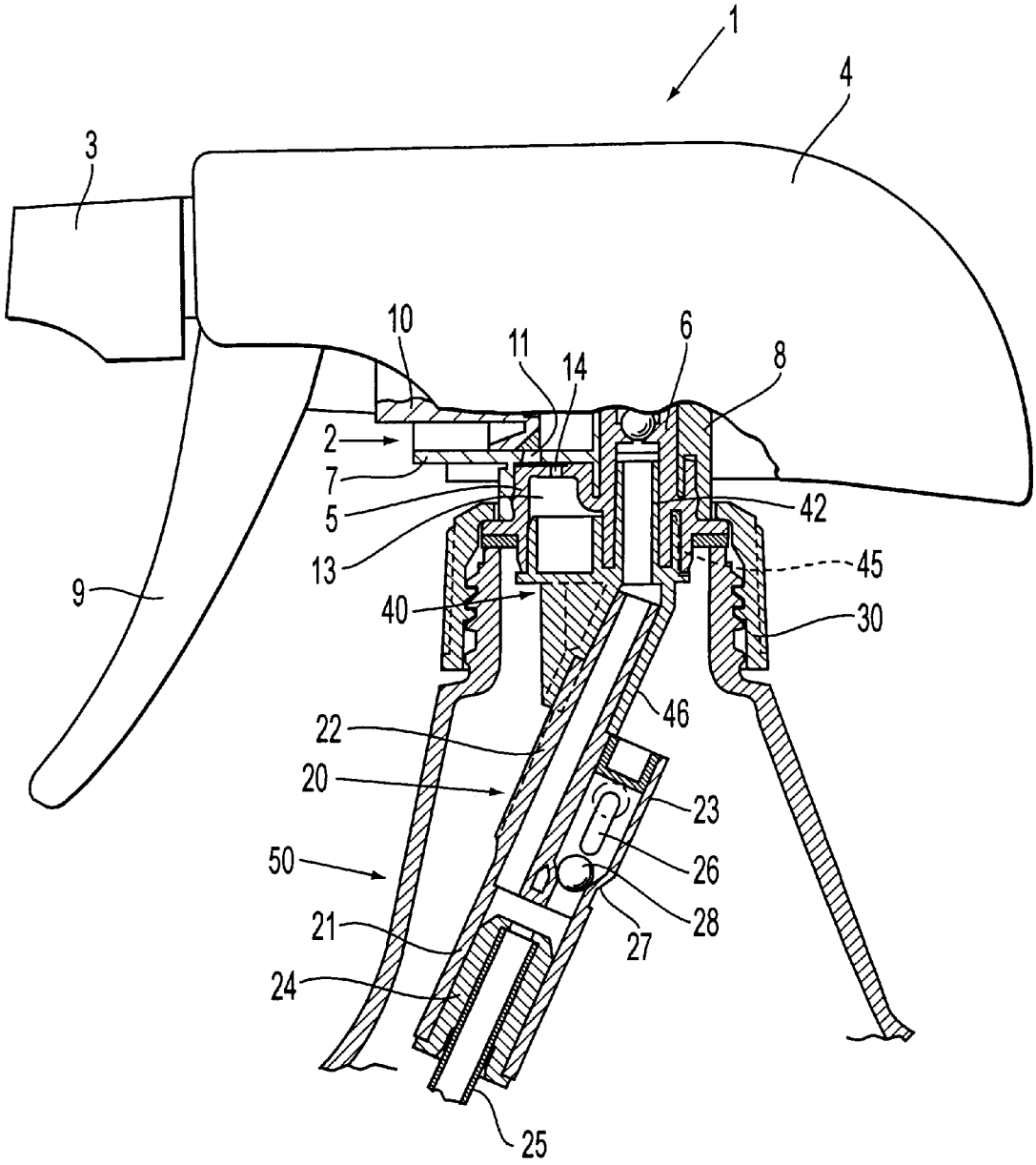
FIG. 2 is an enlarged vertical cross-sectional view of an important section of the embodiment shown in FIG. 1.
Figure 3:
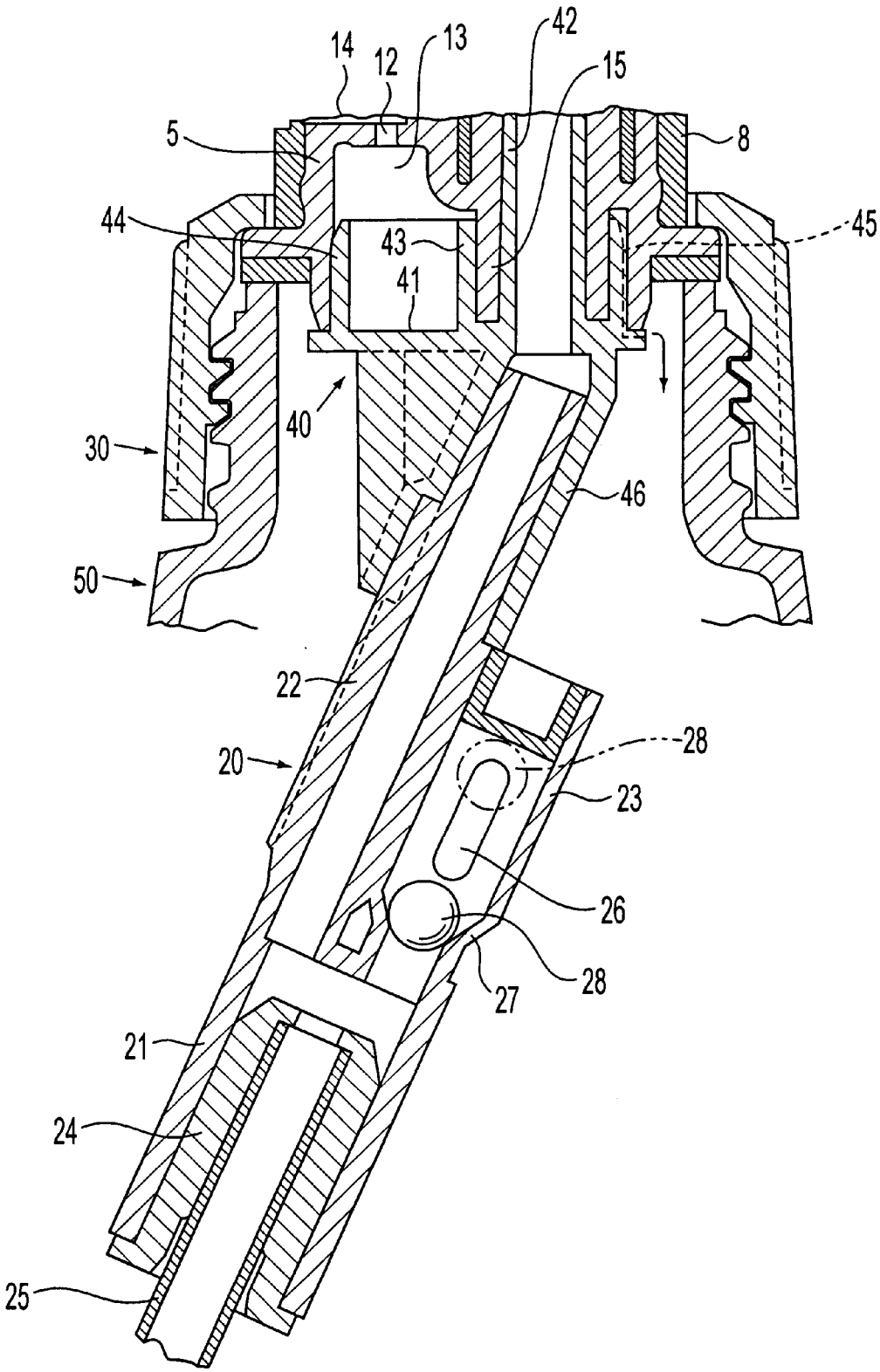
FIG. 3 is a vertical cross-sectional view in which the important section of FIG. 2 has been farther enlarged.
Figure 4:
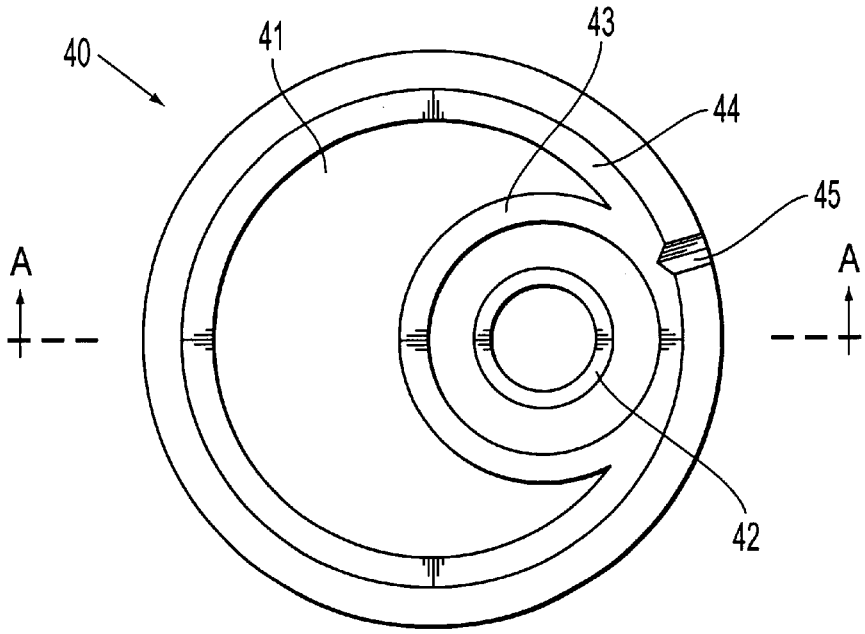
FIG. 4 is a general plan view of the cap unit in the embodiment shown in FIG. 2.
Figure 5:
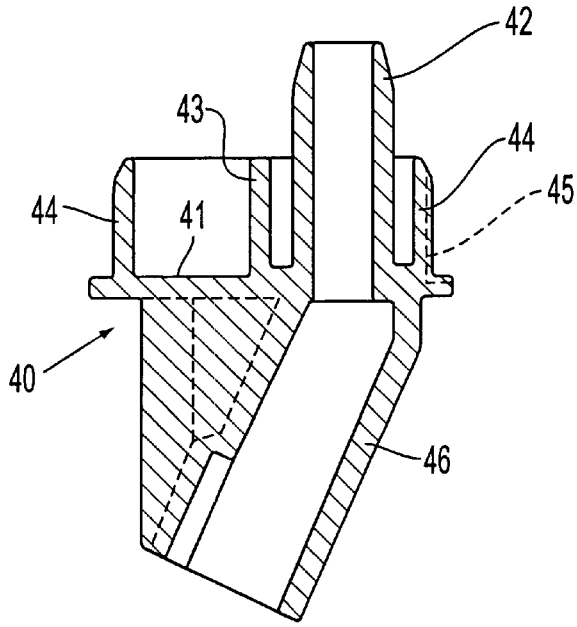
FIG. 5 is a vertical cross-sectional view of the cap unit seen from line A—A in the arrow direction.
Figure 7:
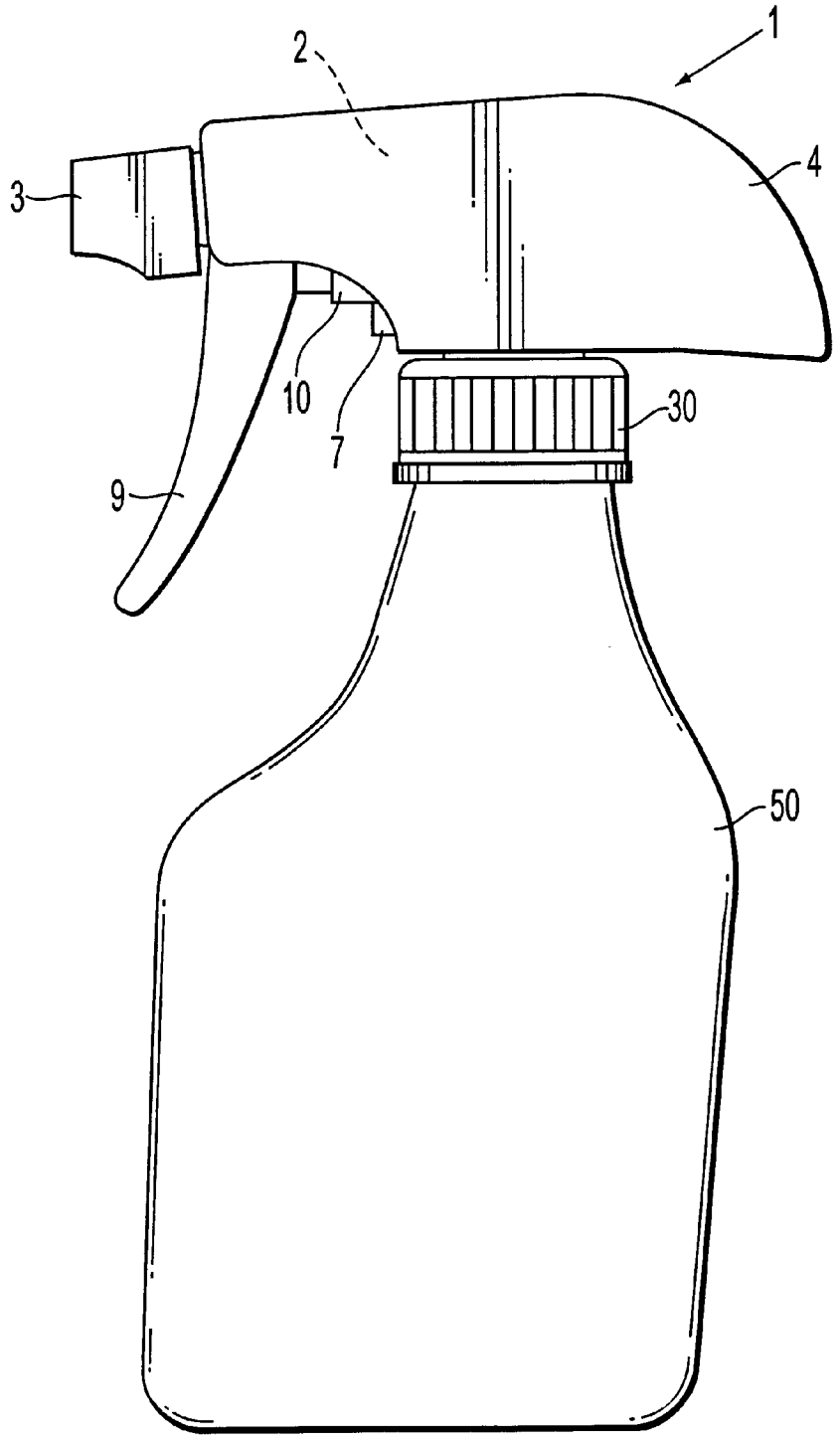
FIG. 7 is a general side view showing the vessel equipped with a manual pump in another embodiment of this invention.
Figure 8:
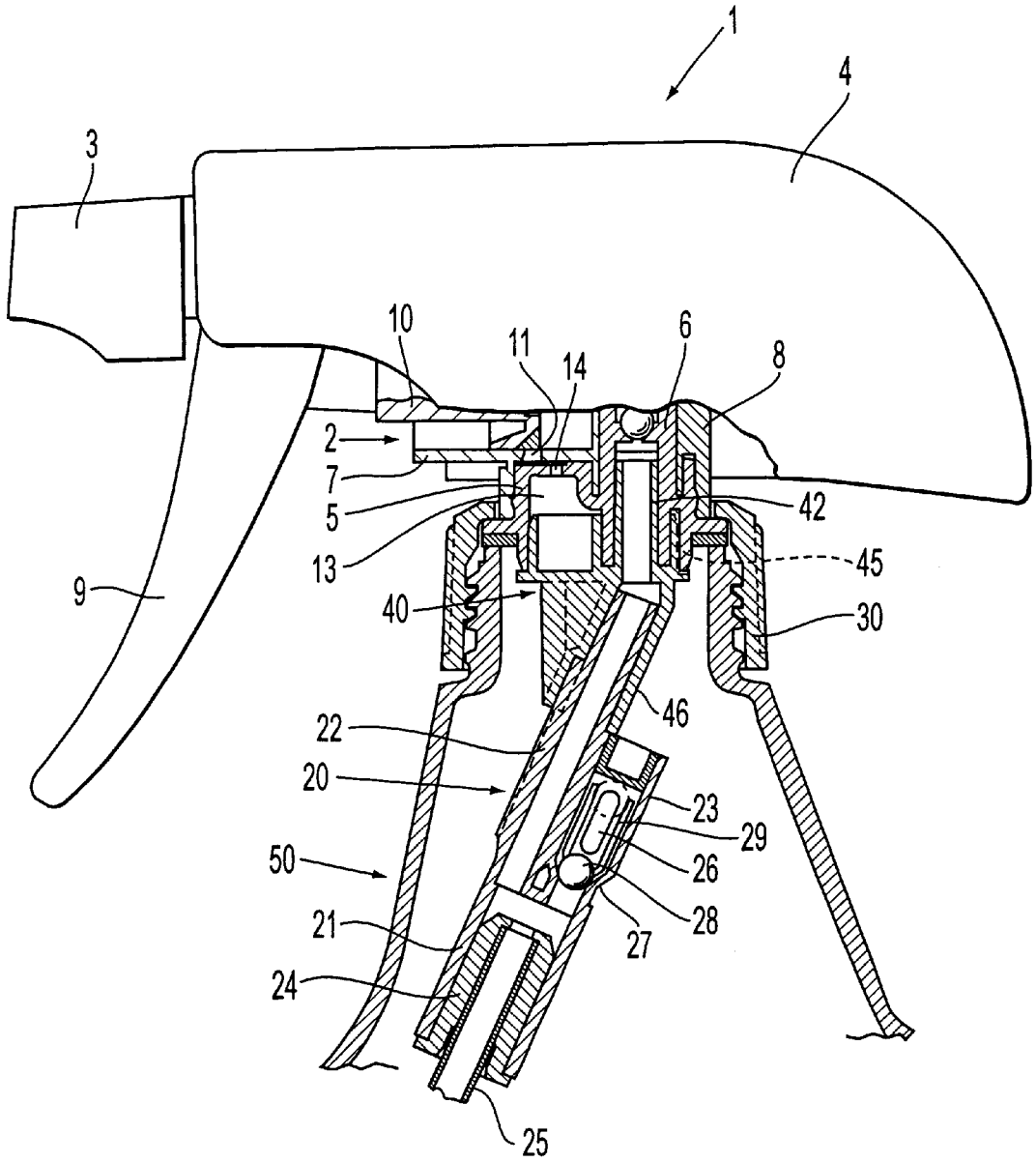
FIG. 8 is an enlarged vertical cross-sectional view of an important section of the embodiment shown in FIG. 7.
Figure 9:
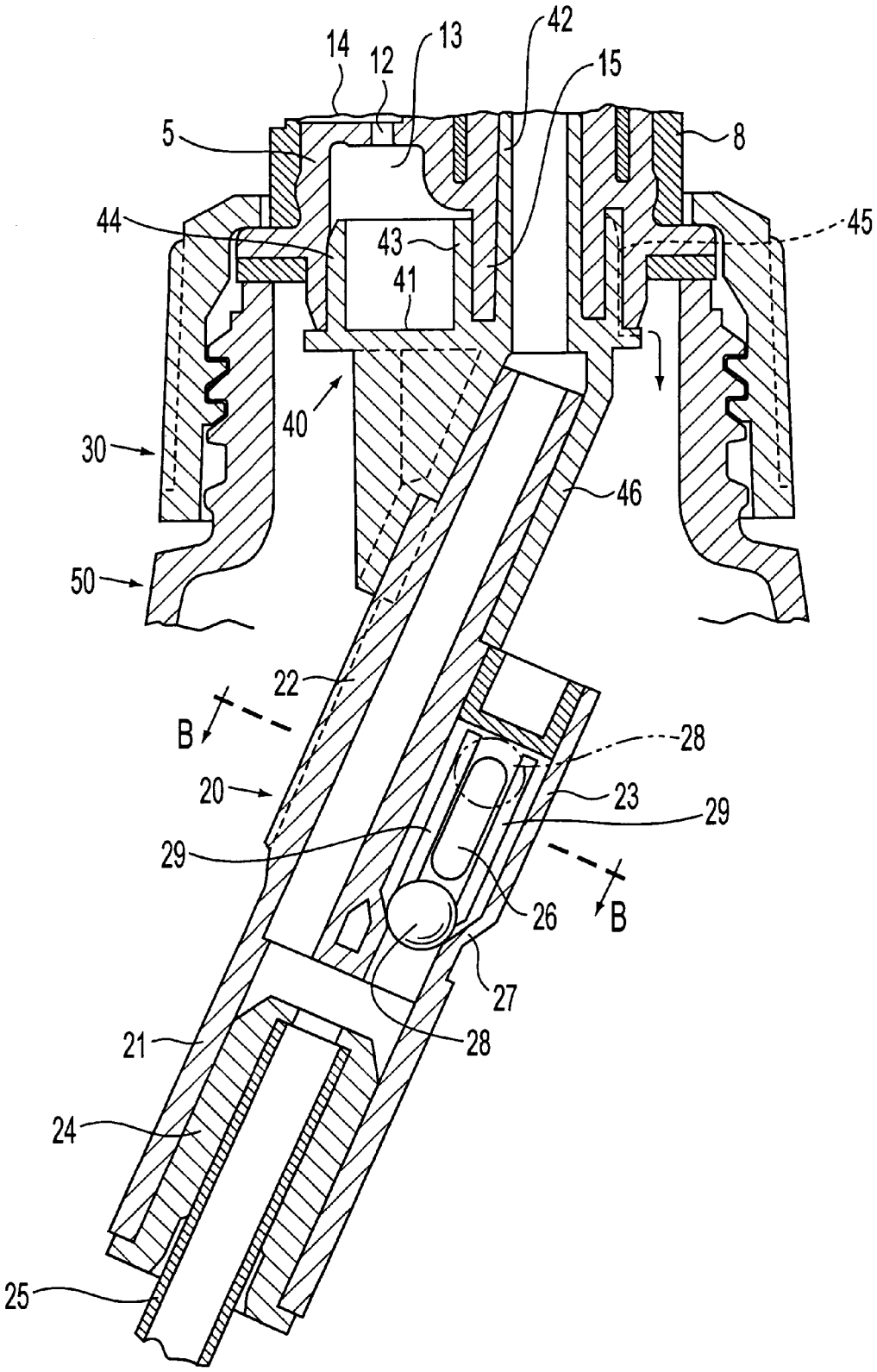
FIG. 9 is a vertical cross-sectional view in which a section of FIG. 8 has been further enlarged.
Figure 10:
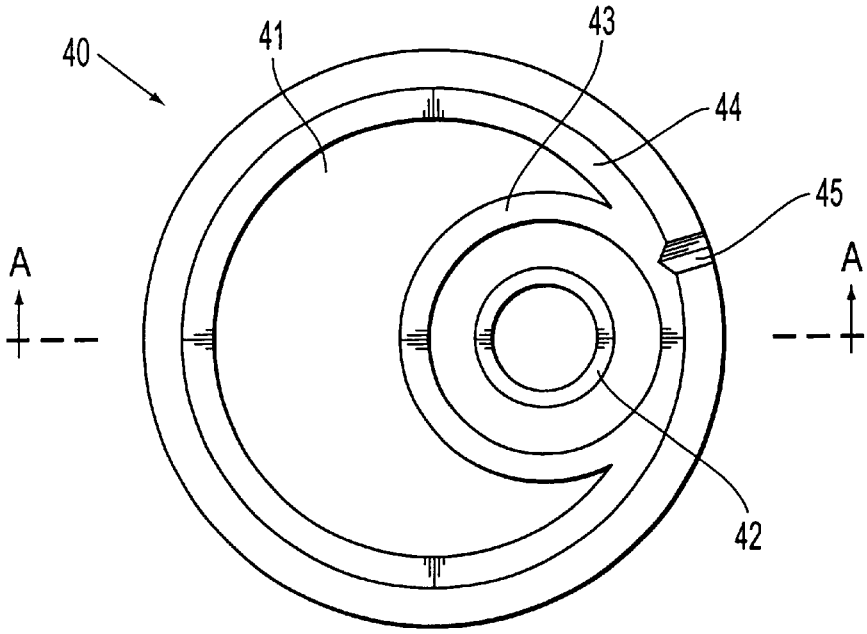
FIG. 10 is a plan view of the cap unit in the embodiment shown in FIG. 8.
Figure 11:
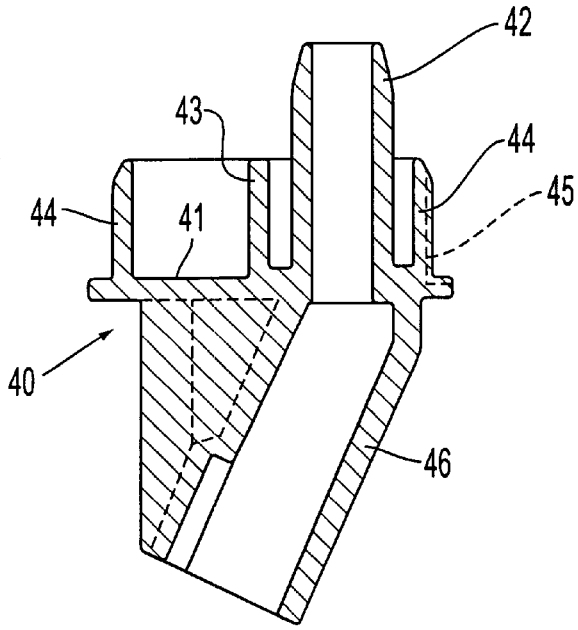
FIG. 11 is a vertical cross-sectional view of the cap unit taken along the line A—A of FIG. 10.

As shown in FIGS. 2, 7 and 8, the pump body 2 is mounted on tube attaching cylinder 5 which is fitted by way of the fitting cap 30 to the upper portion of the mouth of the vessel 50. The pump body 2 is provided with a vertical cylinder 6 having an inside flow channel and a valve mechanism placed at a suitable point halfway along the channel. An external cylinder 8 is fitted around this vertical cylinder 6 and the attaching cylinder 5, and is integrated with the frontal cylinder 7. The flow channel inside the vertical cylinder 6 is connected to the inside of the cylinder 7 and the inside of the nozzle head 3, and is linked with the inside of the vessel 50 by way of the cap unit 40, the change-over valve unit 20, and the sucking pipe 25.

The operating lever 9 is located on the front side of the pump body 2 and is given a bouncing force going back to the original position due to the action of a spring (not shown in the drawings) after the lever 9 has been pulled manually. The lever 9 is connected to the tip of a piston 10 which reciprocates inside the cylinder 7.

A gap 14 is formed partly between the cylinder 7 and the attaching cylinder 5. These cylinders are also provided with air intake holes 11 and 12, respectively, which enable outside air to be linked with a vacant space 13 inside the attaching cylinder 5 through the gap 14.

An inner cylinder portion 15 is vertically suspended on one side of the vacant space 13 inside the attaching cylinder 5. A cap unit 40 is attached to the attaching cylinder 5 from under the vacant space 13 in such a way as to close the space and define the bottom of this space 13.

As shown in FIGS. 4, 5, 10 and 11, this cap unit 40 comprises a liquid flowing conduit cylinder 42 which is fitted all through its length into the inner cylinder portion 15, an inner cylinder 43 which is fitted around the inner cylinder portion 15, and an outer cylinder 44 which is fitted into the attaching cylinder 5; and has an air vent groove 45 disposed at the rear of the cap unit 40, extending from the upper surface of the cylinder bottom 41 vertically up to a point on the outer circumferential surface of the outer cylinder 44.

With this arrangement, the outside and inside of the vessel 50 are linked by the vacuum control air channel, which is formed by the air intake hole 11, the gap 14, the air intake hole 12, the upper portion of the vacant space 13, and the air vent groove 45, in the state in which the piston 10 has moved to the deepest area of the cylinder 7, i.e., in the state in which liquid has been sprayed (See. FIGS. 2, 3, 8, 9, and 10).

A connecting cylinder 46 is suspended under the cylinder bottom 41 of the cap unit 40 and is connected to the conduit cylinder 42. The connecting cylinder 46 is tilted forward and downward from the vertical axis of the conduit cylinder 42, and has a positioning key groove on the inner surface at the front lower end.

The change-over valve unit 20 is disposed slantwise under the cap unit 40 and comprises a long conduit pipe portion 22, of which upper portion is tightly fitted into the connecting cylinder 46 and which has a positioning key ridge on the outer front surface for the engagement with the key groove of the connecting cylinder 46; a short bypass pipe portion 23 with its upper end closed by a cover; and a base pipe portion 21, into which an inner pipe 24 is fitted and which has a sucking pipe tightly fitted into the inner pipe 24.

Figure 6:
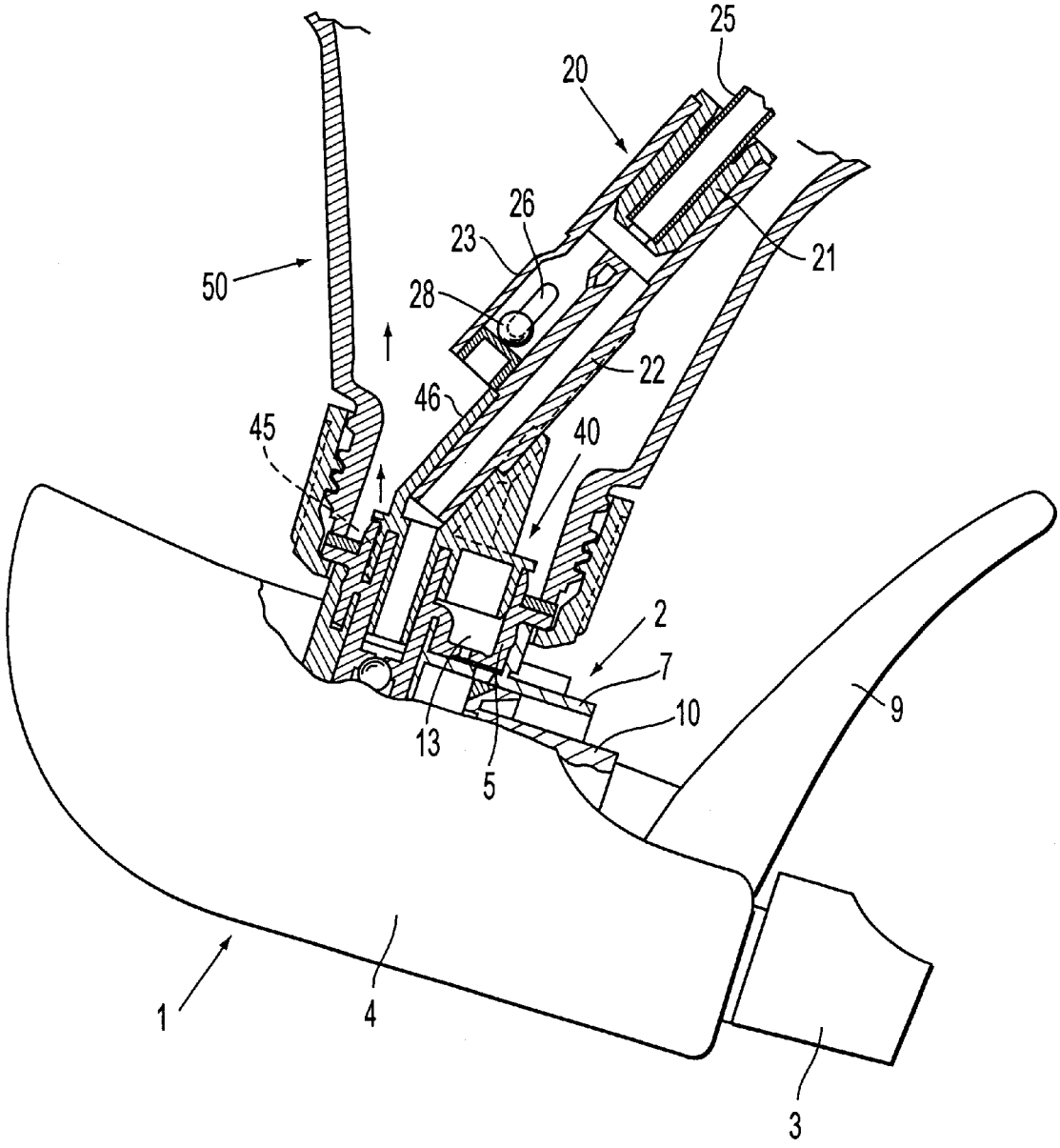
FIG. 6 is an enlarged vertical cross-sectional view of an important section of the embodiment shown in FIG. 1 to be used in an upside-down state.
Figure 13:
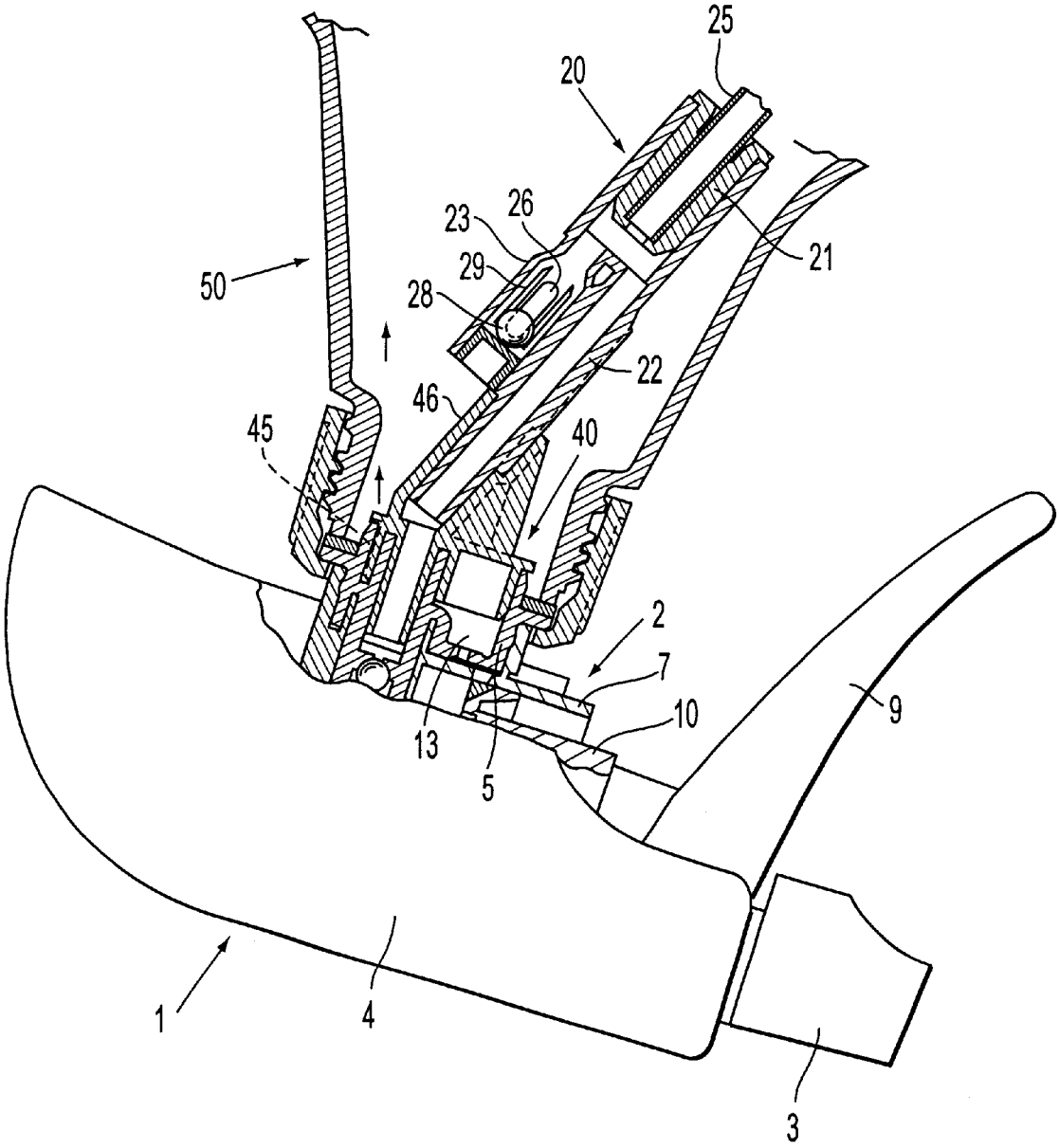
FIG. 13 is an enlarged vertical cross-sectional view of a section of the embodiment shown in FIG. 8 to be used in the upside-down state.

The bypass pipe portion 23 is provided with liquid intake slits 26 in the pipe wall, which are used to take in the liquid and send it to the pump 1 when the vessel is used in the upside-down position, as shown in FIGS. 6 and 13. A spherical check valve 28 sits on the valve seat 27 which is formed in a conical shape by decreasing the pipe diameter toward the lower pipe end.

It is preferred that the change-over valve unit 20 has an angle of about 20 degrees in the forward, downward direction from the vertical axis, so that an assembly consisting of the manual pump 1, the change-over valve unit 20, the sucking pipe 25, and the fitting cap 30 can be accommodated in the vessel 50 smoothly and reasonably, although there are changes in this angle depending on the size and shape of the vessel.

Figure 12:
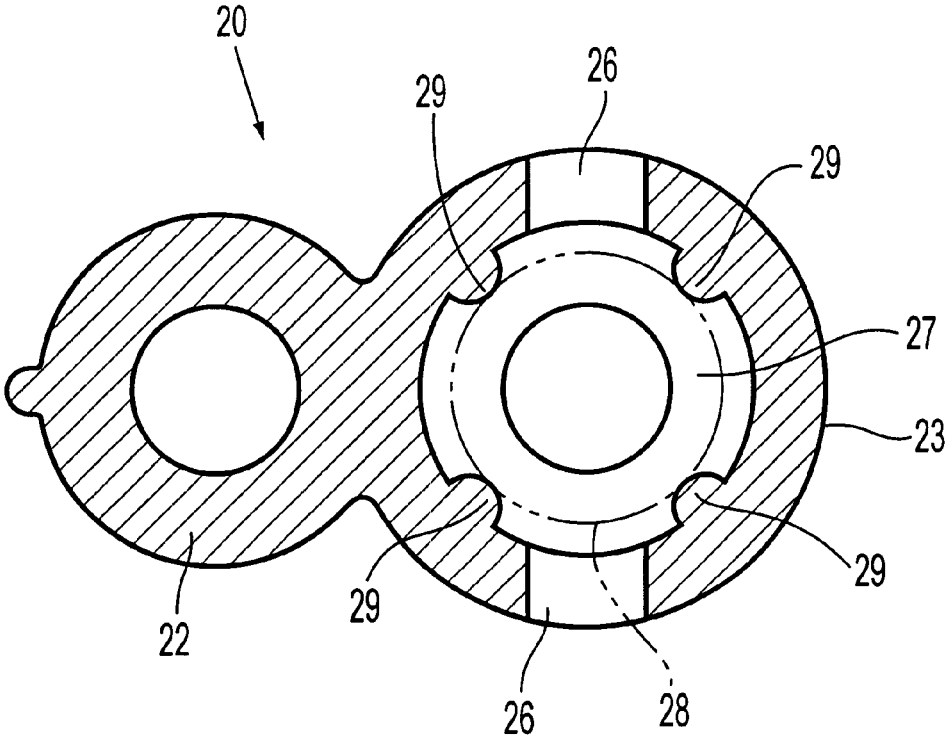
FIG. 12 is a vertical cross-sectional view of the change-over valve unit taken along the line B—B of FIG. 9.

The bypass pipe portion 23 is provided with four guide ribs 29 which are disposed along the entire bypass length at roughly even intervals on the inner circumference, while avoiding a pair of liquid intake slits (See FIG. 12).

In the embodiment wherein the connecting cylinder 46 is disposed in a position tilted forward and downward, the entire change-over valve unit 20 is attached to the connecting cylinder 46 at a posture likewise tilted forward and downward. If the vessel is leaned forward with its front side facing downward, due to a decrease in the liquid volume, then the liquid intake slits 26 of the bypass pipe portion 23 may be exposed to the air, even if the lower end of the sucking pipe 25 remains dipped in the liquid. However, air will never be sucked up into the base pipe portion 21 through the liquid intake slits 26 of the bypass pipe portion 23 because the check valve 28 remains sitting on the valve seat 27 owing to the tilted position of the entire change-over valve unit 20.

This invention described above in the preferred embodiments has the following effectiveness.

In the invention according to claim 1, the vessel has an opening to the vacuum control air channel which takes in air from outside to prevent the vessel from being put under a negative pressure caused by the decrease in liquid volume. This opening of the channel to the vessel is disposed at the rear side of the cap unit. In addition, the change-over valve unit is installed in a position tilted forward and downward. Due to this arrangement, the air taken into the vessel goes up in the liquid as bubbles at a position distant from the liquid intake slits of the bypass pipe portion when the vessel is used in the upside-down position, and thus there is no fear that air flows in the bypass pipe portion through the liquid intake slits. Since air does not mix in the liquid to be discharged forcibly, normal operation can be obtained securely and smoothly to discharge the liquid forcibly from the vessel in the upside-down position.

When the vessel is used in such a position, it is an ordinary practice to discharge the liquid forcibly from the vessel so that the nozzle head faces downward to some extent, rather than in the upright position, for the convenience of easy discharging operation. In such a tilted position, the air taken in from outside rises to the liquid surface near the inner rear wall. Because this bubble-rising position is distant from the liquid intake slits of the bypass pipe portion, the air intake through the liquid intake slits is certainly avoided.

In the invention according to claim 2, the connecting cylinder is attached slantwise to the cap unit, which is a component of the fitting cap. This simple arrangement enables the change-ever valve unit to be attached in a certain tilted posture and therefore to be utilized in its existing structure, thus making it possible for the invention to be practiced simply and inexpensively.

In the invention according to claim 3, the check valve in the bypass pipe portion steadily achieves its check work, and prevents air from being sucked up into the pumping area rough the bypass pipe portion, when the vessel is used at such an angle that the bypass pipe portion is put in a roughly horizontal position, and when at that time, the bypass pipe portion is exposed to air. Therefore, even if there is a decrease in the liquid volume inside the vessel, it is possible to discharge the liquid securely and stably from the vessel in its lying position.

Since the bypass pipe portion of the change-over valve unit has a simple structure comprising multiple guide ribs disposed around the inner wall of the bypass, the water flow through the bypass pipe portion can be secured easily and properly.

What is claimed:

1. A vessel assembly that can be used in an upside-down position, the vessel assembly comprising:

a vessel for containing a liquid;

a manual pump attached to a mouth of the vessel with an attaching cylinder, the manual pump being manually operable to draw the liquid through an intake pipe portion and to discharge the liquid forcibly from the vessel;

a cap unit attached to the attaching cylinder from beneath, the cap unit having a liquid-flowing conduit cylinder linked to the manual pump;

a change-over valve unit fitted into the cap unit from beneath, the change-over valve unit comprising;

a base pipe portion, the intake pipe portion being connected to a lower end of the base pipe portion;

a conduit pipe portion disposed on the base pipe portion and linked to the conduit cylinder, the conduit pipe portion being tilted forward and downward in the vessel and a lower part of the conduit pipe portion being parallel with a bypass pipe portion; and the bypass pipe portion tilted forward and downward in the vessel, the bypass pipe portion including a bypass wall, a pair of liquid intake slits in the bypass wall, and a check valve provided inside the bypass pipe portion, the bypass pipe being closed at an upper end; wherein:

when the vessel is in an upright position, the check valve is closed and the liquid is prevented from flowing between the conduit pipe portion and the bypass pipe portion; and when the vessel is in the upside-down position, the check valve is open and the liquid can flow between the conduit pipe portion and the bypass pipe portion; and a vacuum control air channel in the attaching cylinder for supplying air to the inside of the vessel, the vacuum control air channel including a first opening in a cylinder of the manual pump that communicates with an exterior of the vessel when a piston of the manual pump has moved to the inside of the cylinder and a second opening disposed at a rear portion of the cap unit, the second opening communicating with an interior of the vessel; and wherein when the vessel is used in the upside-down position, air entering through the vacuum control air channel does not communicate with the liquid intake slits as the air passes through the liquid.

2. The vessel assembly of claim 1, comprising a connecting cylinder disposed under the cap unit in a position tilted forward and downward, and linked to the conduit cylinder, wherein the upper portion of the conduit pipe portion of the change-over valve unit is fitted tightly into the connecting cylinder.

3. The vessel assembly of claim 2, wherein:

the change-over valve unit comprises a check valve including at least three guide ribs having a vertical ridge shape;

the guide ribs are disposed circumferentially around the inner surface of the bypass pipe portion of a larger bore diameter than the diameter of the check valve, in an arrangement that maintains the check valve axially at the center of the bypass portion; and the guide ribs are disposed at a height such that the diameter of the imaginary circle formed by connecting all the peaks of the guide ribs is larger than the diameter of the check valve.

4. The vessel assembly of claim 1, wherein:

the change-over valve unit comprises a check valve including at least three guide ribs having a vertical ridge shape;

the guide ribs are disposed circumferentially around the inner surface of the bypass pipe portion of a larger bore diameter than the diameter of the check valve, in an arrangement that maintains the check valve axially at the center of the bypass portion; and the guide ribs are disposed at a height such that the diameter of the imaginary circle formed by connecting all the peaks of the guide ribs is larger than the diameter of the check valve.

* * * * *